US011111750B1

(12) United States Patent
Kelly, III

(10) Patent No.: US 11,111,750 B1
(45) Date of Patent: Sep. 7, 2021

(54) TELESCOPING ELECTRICAL CONNECTOR JOINT

(71) Applicant: Saudi Arabian Oil Company, Dhahran (SA)

(72) Inventor: Benton Kelly, III, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/797,647

(22) Filed: Feb. 21, 2020

(51) Int. Cl.
*E21B 33/035* (2006.01)
*E21B 23/06* (2006.01)
*E21B 19/00* (2006.01)

(52) U.S. Cl.
CPC ..... *E21B 33/035* (2013.01); *E21B 19/006* (2013.01); *E21B 23/06* (2013.01)

(58) Field of Classification Search
CPC .. E21B 33/035; E21B 33/038; E21B 33/0353; E21B 19/006; E21B 23/06; E21B 17/028
See application file for complete search history.

(56) References Cited

U.S. PATENT DOCUMENTS 2,178,931 A * 11/1939 Crites ..... H01B 7/0072 439/191
2,437,510 A 3/1948 Ditty
4,921,438 A 4/1990 Godfrey et al.
6,394,837 B1 5/2002 Edwards et al.
6,974,341 B2 12/2005 Jennings
7,225,876 B2 6/2007 Laureano
7,814,969 B2 * 10/2010 Shaw ..... E21B 43/128 166/65.1
8,596,348 B2 12/2013 Brookbank
9,028,264 B2 5/2015 Head
(Continued)

FOREIGN PATENT DOCUMENTS

CA 2296195 C 12/2004
WO 2014089132 A1 6/2014

OTHER PUBLICATIONS

Izetti, R., et al., "Downhole Electrical Disconnect Tool Enables the Parting and Subsequent Re-Connection of the Upper Completion Containing an ESP from the Lower Intelligent Completion," SPE International, SPE-172193-MS, 2014.
(Continued)

*Primary Examiner* — James G Sayre
(74) *Attorney, Agent, or Firm* — Bracewell LLP; Constance G. Rhebergen; Linda L. Morgan

(57) ABSTRACT

A telescoping connector joint for making an electrical connection includes a first tubular member with a first internal bore. A second tubular member is located within the first internal bore defining a joint annular space between an outer diameter surface of the second tubular member and an inner diameter surface of the internal bore. An annular seal assembly seals the joint annular space. A female wet connect member is located on one of the first tubular member and the second tubular member, and a male wet connect member is located on the other. The telescoping connector joint has a connected configuration where the female wet connect member is in electrical engagement with the male wet connect member and has an unconnected configuration where the female wet connect member is free of electrical engagement with the male wet connect member.

18 Claims, 4 Drawing Sheets

(56) References Cited

U.S. PATENT DOCUMENTS

| | | | | |
|---|---|---|---|---|
| 9,175,523 | B2 | 11/2015 | Patel et al. | |
| 9,322,252 | B2 | 4/2016 | Head | |
| 9,371,703 | B2 | 6/2016 | Roane et al. | |
| 9,556,716 | B2 | 1/2017 | Kirkpatrick | |
| 9,664,000 | B2 | 5/2017 | Richards | |
| 10,060,196 | B2 | 8/2018 | Richards | |
| 10,184,301 | B2 | 1/2019 | Perry et al. | |
| 2008/0047703 | A1* | 2/2008 | Stoesz | E21B 17/028 166/65.1 |
| 2010/0300698 | A1 | 12/2010 | Bedouet et al. | |
| 2011/0024104 | A1 | 2/2011 | Griffiths | |
| 2011/0259601 | A1 | 10/2011 | Withers | |
| 2013/0062050 | A1 | 3/2013 | Head | |
| 2013/0187496 | A1 | 7/2013 | Creeden et al. | |
| 2015/0129240 | A1 | 5/2015 | Bishop et al. | |
| 2018/0187493 | A1* | 7/2018 | Lastra | E21B 23/01 |

OTHER PUBLICATIONS

Laureano, M. P., "Improved High Voltage Connection System for Subsea Electrical Submersible Pumps," Offshore Technology Conference, OTC-17520, 2005.

International Search Report and Written Opinion of PCT Application No. PCT/US2021/018924 dated May 12, 2021: pp. 1-17.

* cited by examiner

TELESCOPING ELECTRICAL CONNECTOR JOINT

BACKGROUND

1. Field of the Disclosure

The present disclosure relates in general to electrical connections used in subterranean wells, and more particularly to a telescoping joint of a tubing string that allows for moving uphole components of the tubing string to test electrical connections.

2. Description of the Related Art

A currently available method for producing hydrocarbons from a subterranean reservoir to the surface through a subterranean well is to pump the fluids from the reservoir to the surface. An electrical submersible pump (ESP) can be used for such purpose. The ESP in its basic components can include a down hole pump, motor and other components to produce fluids to the surface. The ESP can require the use of electricity supplied from the surface as a power source to drive the downhole motor. The ESP can be installed below a downhole packer.

The electrical cable for the ESP can be run alongside the production tubing from the top of the ESP thru the downhole packer and then terminated in the tubing hanger at surface. One source of failure for the electrical cables is just below the tubing hanger. The electrical cables can fail at the feed thrus that connect the electrical cable to the tubing hanger.

SUMMARY OF THE DISCLOSURE

Currently available methods for testing and changing out the electrical cables feed thrus or repair the terminations below the hanger require that the entire well be decompleted in order to reach the connections just below the tubing hanger. In such a case, a workover rig would be required to remove the well completion, including the entire string of production tubing and the ESP.

Systems and methods of this disclosure instead provide a telescoping connector joint that can be deployed below the tubing hanger and above an electrical submersible pump packer. The telescoping connector joint allows the tubing hanger and the production tubing uphole of the telescoping connector joint to be moved axially in an uphole direction a preset distance. The telescoping connector joint of this disclosure can also be able to conduct electrical current and support the entire weight of the production string, including tools and equipment that are part of the production string, below the telescoping connector joint. The telescoping connector joint can also allow the tubing hanger to electrically de couple from the ESP and can maintain a pressure seal around the electrical connector.

In an embodiment of this disclosure, a telescoping connector joint for making an electrical connection includes a first tubular member with a first internal bore. A second tubular member with a second internal bore is in fluid communication with the first internal bore. The second tubular member is located within the first internal bore such than a joint annular space is defined between an outer diameter surface of the second tubular member and an inner diameter surface of the first internal bore. An annular seal assembly seals the joint annular space. A female wet connect member is located on one of the first tubular member and the second tubular member. A male wet connect member is located on the other of the first tubular member and the second tubular member. The telescoping connector joint has a connected configuration where the female wet connect member is in electrical engagement with the male wet connect member and a maximum length of the second tubular member is located within the first internal bore. The telescoping connector joint has an unconnected configuration where the female wet connect member is free of electrical engagement with the male wet connect member and less than the maximum length of the second tubular member is located within the first internal bore.

In alternate embodiments, the annular seal assembly can include a chevron seal located within the joint annular space. The second tubular member can include a lug that protrudes radially outward. The lug can engage an axially oriented recess located within the first internal bore. The telescoping connector joint can be operable to move from the connected configuration to the unconnected configuration by relative axial movement of the first tubular member in a direction away from the second tubular member.

In an alternate embodiment, a telescoping connector joint system for making an electrical connection includes a first tubular member with a first internal bore. The first tubular member has a first connector end secured to a first tubular joint. The first internal bore has a first mating end that is opposite the first connector end of the first tubular member. A second tubular member with a second mating end is located within the first internal bore such that a joint annular space is defined between an outer diameter surface of the second tubular member and an inner diameter surface of the first internal bore. The second tubular member has a second connector end that is opposite the second mating end and that is secured to a second tubular joint. An annular seal assembly seals the joint annular space. A wet connection has a female wet connect member located on one of the first tubular member and the second tubular member and a male wet connect member located on the other of the first tubular member and the second tubular member. A tubing hanger is located uphole of the wet connection. A downhole packer is located downhole of the wet connection. The telescoping connector joint system has a connected configuration where the female wet connect member is in electrical engagement with the male wet connect member and a maximum length of the second tubular member is located within the first internal bore. The telescoping connector joint system has an unconnected configuration where the female wet connect member is free of electrical engagement with the male wet connect member and less than the maximum length of the second tubular member is located within the first internal bore.

In alternate embodiments, an uphole cable can extend in a direction uphole from the wet connection to the tubing hanger. A downhole cable can extend in a direction downhole from the wet connection to the downhole packer. An electrical submersible pump can be located downhole of the downhole packer. When the telescoping connector joint system is in the connected configuration the uphole cable and the downhole cable can be in power communication with the electrical submersible pump.

In other alternate embodiments, the second tubular member can include a lug that protrudes radially outward. The lug can engage an axially oriented recess located within the first internal bore, such that the lug is operable to transfer a weight of the telescoping connector joint system downhole of the lug to the first tubular member. The telescoping connector joint system can be operable to move from the connected configuration to the unconnected configuration by axial movement of the tubing hanger in a direction away from the downhole packer. The downhole packer can be operable to engage an inner diameter surface of a wellbore and support a weight of the telescoping connector joint system downhole of second tubular member.

In yet another embodiment of this disclosure, a method for making an electrical connection with a telescoping connector joint includes providing a first tubular member with a first internal bore. A second tubular member with a second internal bore in fluid communication with the first internal bore is located within the first internal bore such than a joint annular space is defined between an outer diameter surface of the second tubular member and an inner diameter surface of the first internal bore. The joint annular space is sealed with an annular seal assembly. A female wet connect member is located on one of the first tubular member and the second tubular member and a male wet connect member is located on the other of the first tubular member and the second tubular member. The telescoping connector joint is moved between an unconnected configuration and a connected configuration. In the connected configuration, the female wet connect member is in electrical engagement with the male wet connect member and a maximum length of the second tubular member is located within the first internal bore. In the unconnected configuration, the female wet connect member is free of electrical engagement with the male wet connect member and less than the maximum length of the second tubular member is located within the first internal bore.

In alternate embodiments, sealing the joint annular space with the annular seal assembly can include sealing the joint annular space with a chevron seal that is located within the joint annular space. The second tubular member can include a lug that protrudes radially outward, and the method can further include engaging an axially oriented recess located within the first internal bore with the lug to allow for relative axial movement between the first tubular member and the second tubular member. Moving the telescoping connector joint from the connected configuration to the unconnected configuration can be by relative axial movement of the first tubular member in a direction away from the second tubular member.

In still another alternate embodiment, a method of making an electrical connection with a telescoping connector joint system include providing a first tubular member with a first internal bore. The first internal bore has a first mating end that is opposite a first connector end of the first tubular member. A second tubular member with a second mating end is located within the first internal bore such than a joint annular space is defined between an outer diameter surface of the second tubular member and an inner diameter surface of the first internal bore. The second tubular member has a second connector end opposite the second mating end. The joint annular space is sealed with an annular seal assembly. A wet connection having a female wet connect member is located on one of the first tubular member and the second tubular member and a male wet connect member is located on the other of the first tubular member and the second tubular member. The first connector end is secured to a first tubular joint, and the second connector end is secured to a second tubular joint. A downhole packer is installed downhole of the wet connection. A tubing hanger is installed uphole of the wet connection. The telescoping connector joint system has a connected configuration where the female wet connect member is in electrical engagement with the male wet connect member and a maximum length of the second tubular member is located within the first internal bore. The telescoping connector joint system has an unconnected configuration where the female wet connect member is free of electrical engagement with the male wet connect member and less than the maximum length of the second tubular member is located within the first internal bore.

In alternate embodiments, the method can further include extending an uphole cable in a direction uphole from the wet connection to the tubing hanger, and extending a downhole cable in a direction downhole from the wet connection to the downhole packer. An electrical submersible pump can be located downhole of the downhole packer. Power can be provided to the electrical submersible pump with the uphole cable and the downhole cable when the telescoping connector joint system is in the connected configuration.

In other alternate embodiments, the second tubular member can include a lug that protrudes radially outward. The lug can engage an axially oriented recess located within the first internal bore and the method can further include transferring a weight of the telescoping connector joint system downhole of the lug to the first tubular member by way of the lug. The telescoping connector joint system can be moved from the connected configuration to the unconnected configuration by axial movement of the tubing hanger in a direction away from the downhole packer. An inner diameter surface of a wellbore can be engaged with the downhole packer and a weight of the telescoping connector joint system downhole of the second tubular member can be supported with the downhole packer.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
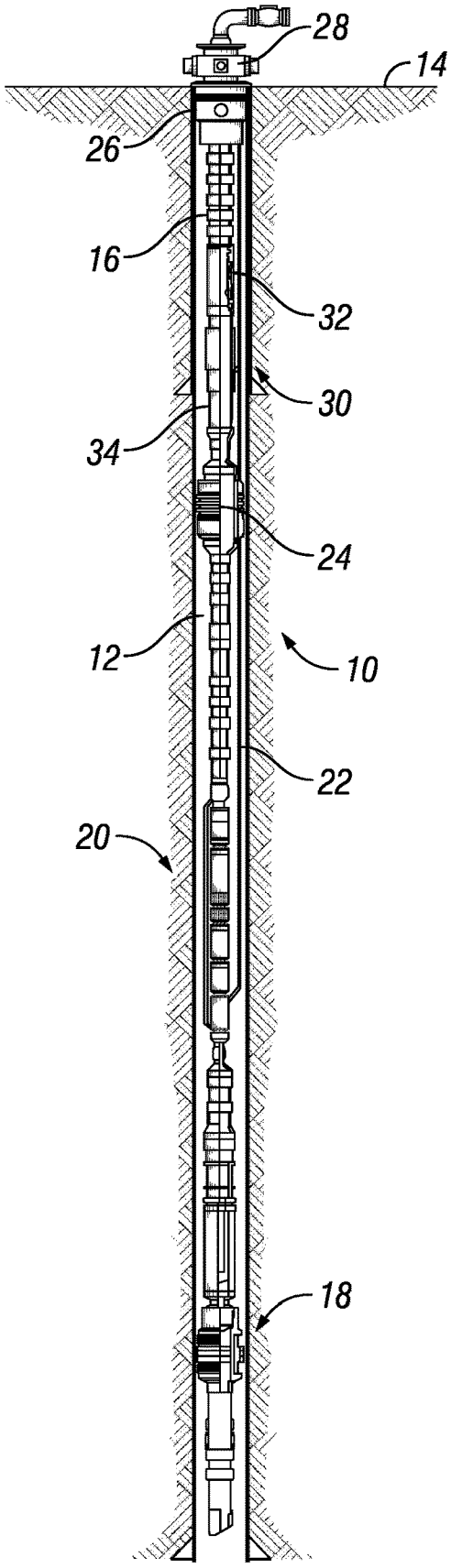
FIG. 1 is a schematic partial sectional elevation view of a subterranean well with a telescoping connector joint, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Wellbore 12 can be drilled from surface 14 and into and through various subterranean formations.

A completion or production string 16 can be used to deliver the fluids from the hydrocarbon reservoir to the surface. Production string 16 can include a lower isolation assembly 18. Lower isolation assembly 18 can engage an inner diameter surface of wellbore 12 so that lower isolation assembly 18 seals the space between production string 16 and wellbore 12. Lower isolation assembly 18 can prevent the flow of fluids past lower isolation assembly 18 radially outward of lower isolation assembly 18. Fluids that are downhole of lower isolation assembly 18 will instead enter the central bore of production string 16 to be produced to the surface through production string 16.

Electrical submersible pump (ESP) assembly 20 can be used to provide lift to the hydrocarbon fluids for assisting in delivering such hydrocarbon fluids to the surface. ESP assembly 20 can have a motor that uses electrical power that is provided by way of cable 22.

Downhole packer 24 can be located uphole of ESP assembly 20. Downhole packer 24 can engage an inner diameter surface of wellbore 12 so that downhole packer 24 seals the space between production string 16 and wellbore 12. Downhole packer 24 can prevent the flow of fluids past downhole packer 24 radially outward of downhole packer 24. Downhole packer 24 and lower isolation assembly 18 can be used together to isolate the wellbore between downhole packer 24 and lower isolation assembly 18, including the wellbore around ESP assembly 20. Fluids that are in wellbore 12 radially outward of production string 16 can be directed to the bore of production string 16 and be produced to the surface through the bore of production string 16.

Production string 16 can be suspended within wellbore 12 from tubing hanger 26. Cable 22 can terminate at tubing hanger 26 and can be formed of segments that extend from tubing hanger 26 to ESP assembly 20. Although FIG. 1 shows cable 22 extending to an ESP assembly, in alternate embodiments, cable 22 can be used to provide electrical power, data, or other signal communication to downhole tools or equipment that is in need of such electrical power, data, or other signal communication.

Fluids that are produced through production string 16 can be delivered through wellhead 28 at the surface 14.

If it is required or desirable to lift tubing hanger 26 for inspection, repair, or other purposes, telescoping connector joint 30 can allow for the lifting of tubing hanger 26 a predetermined distance, while allowing downhole packer 24 and each of the components of production string 16 downhole of downhole packer 24 to remain static within wellbore 12. For example, if there is an electrical failure, the connection of cable 22 below and through tubing hanger 26 can be examined by lifting tubing hanger 26. As an example, lifting tubing hanger 26 ten feet from the installed position would allow for the inspection of the cable proximate to tubing hanger 26.

As tubing hanger 26 is lifted, the components along cable 22 are separated so that the supply of electrical power and communication to ESP assembly 20 is disconnected. When tubing hanger 26 is lowered again and returns to the operating position, the components along cable 22 that were separated by lifting tubing hanger 26 are re-engaged so that the supply of electrical power and communication to ESP assembly 20 is resumed.

Telescoping connector joint 30 is secured in line as part of production string 16. Ends of telescoping connector joint 30 are connected to adjacent tubular joints of production string 16. As an example, an uphole end of telescoping connector joint 30 is connected to an uphole or first tubular joint 32, and a downhole end of telescoping connector joint 30 is connected to a downhole or second tubular joint 34 of production string 16.

Figure 2:
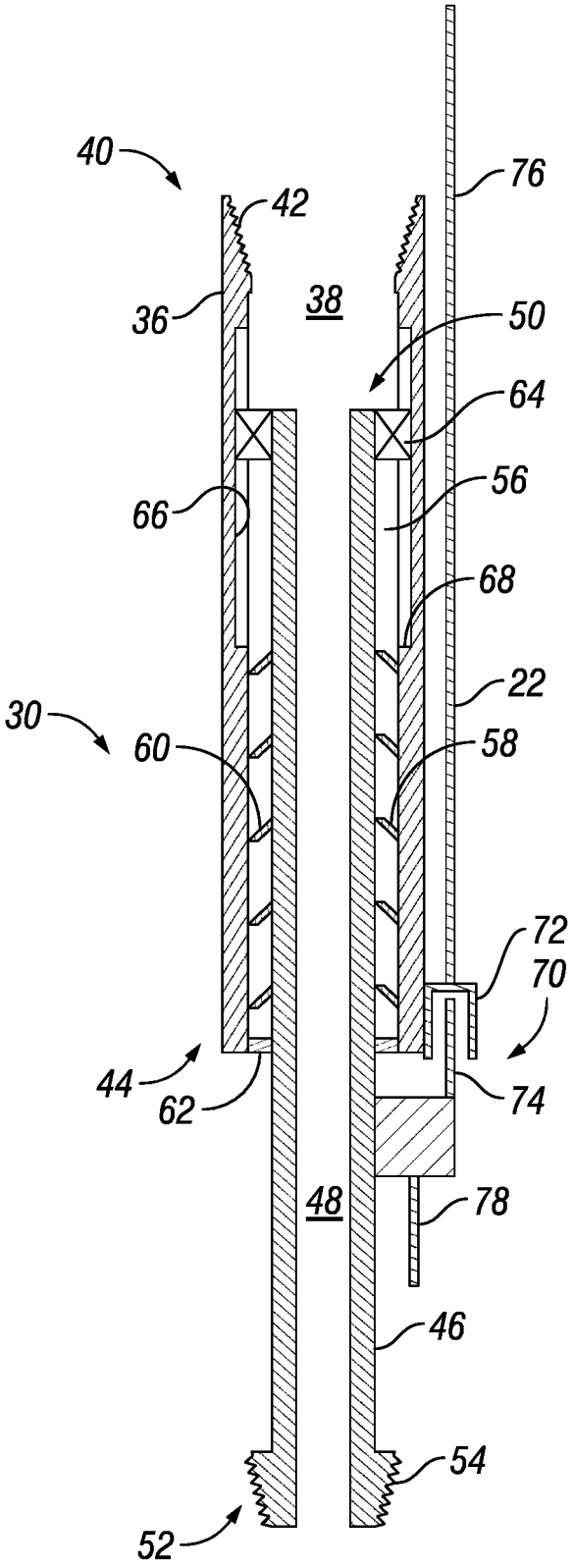
FIG. 2 is a schematic sectional elevation view of a telescoping connector joint, in accordance with an embodiment of this disclosure, showing the telescoping connector joint in the connected configuration.
Figure 3:
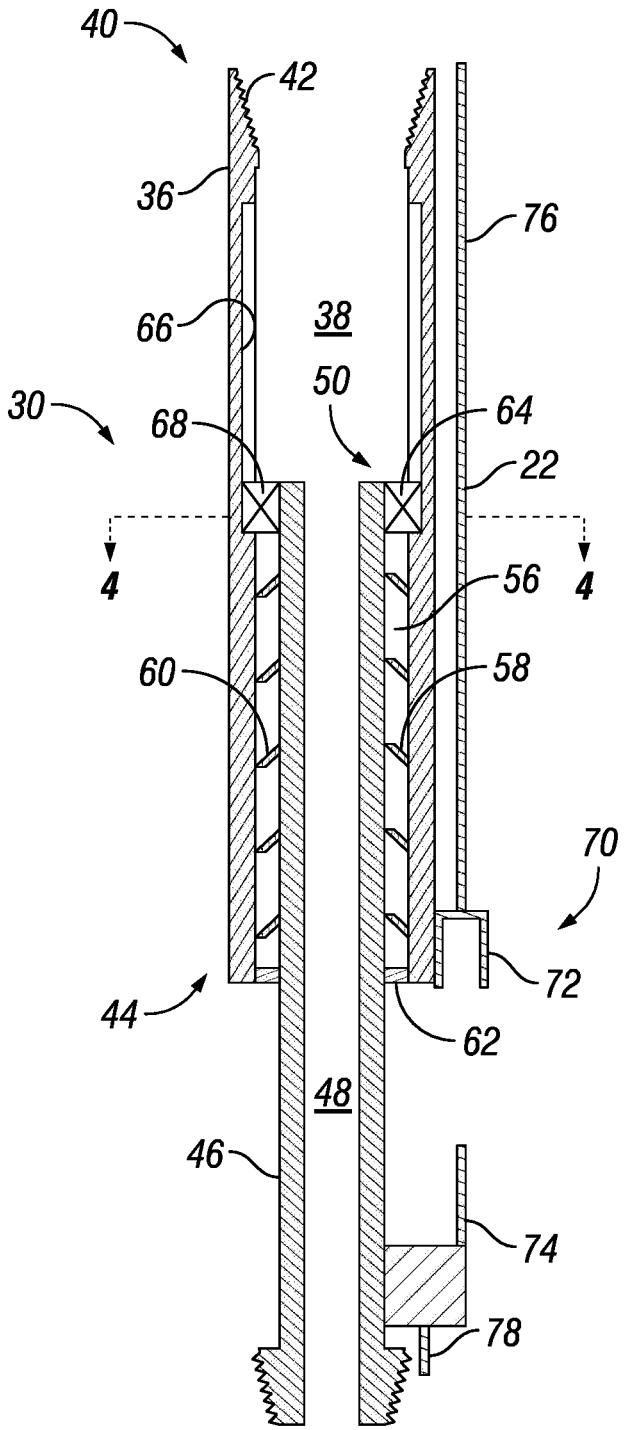
FIG. 3 is a schematic sectional elevation view of a telescoping connector joint, in accordance with an embodiment of this disclosure, showing the telescoping connector joint in the unconnected configuration.

Looking at FIGS. 2-3, telescoping connector joint 30 includes first tubular member 36. First tubular member 36 has first internal bore 38. First tubular member 36 has first connector end 40 that can be secured to first tubular joint 32 (FIG. 1) with first connector 42. In the example embodiment of FIG. 2, first connector 42 is a threaded connector that could, for example, be threadingly secured to a pin member of first tubular joint 32. First tubular member 36 has first mating end 44 that is opposite first connector end 40 of first tubular member 36.

Telescoping connector joint 30 also includes second tubular member 46. Second tubular member 46 has second internal bore 48 that is in fluid communication with first internal bore 38. Second tubular member 46 has second mating end 50 that is located within first internal bore 38. Second tubular member 46 passes though first mating end 44 of first tubular member 36.

Second tubular member 46 has second connector end 52 that can be secured to second tubular joint 34 (FIG. 1) with second connector 54. In the example embodiment of FIG. 2, second connector 54 is a threaded connector that could, for example, be threadingly secured to a box member of second tubular joint 34. Second connector end 52 is opposite second mating end 50 of second tubular member 46.

Joint annular space 56 is defined between an outer diameter surface of second tubular member 46 and an inner diameter surface of first internal bore 38 of first tubular member 36. Annular seal assembly 58 can be used to seal across joint annular space 56. Annular seal assembly 58 can sealingly engage the outer diameter surface of second tubular member 46 and the inner diameter surface of first internal bore 38 of first tubular member 36.

In the example of FIG. 2, annular seal assembly 58 includes a plurality of chevron seals 60 and a ring seal 62. In alternate embodiments, a combination of any number of chevron seals 60 and ring seals 62 may be used. In other alternate embodiments, annular seal assembly 58 can include alternate currently available seals for sealing annular spaces within a downhole environment that allow for relative axial movement between concentric members that are engaged by the seal.

Figure 4:
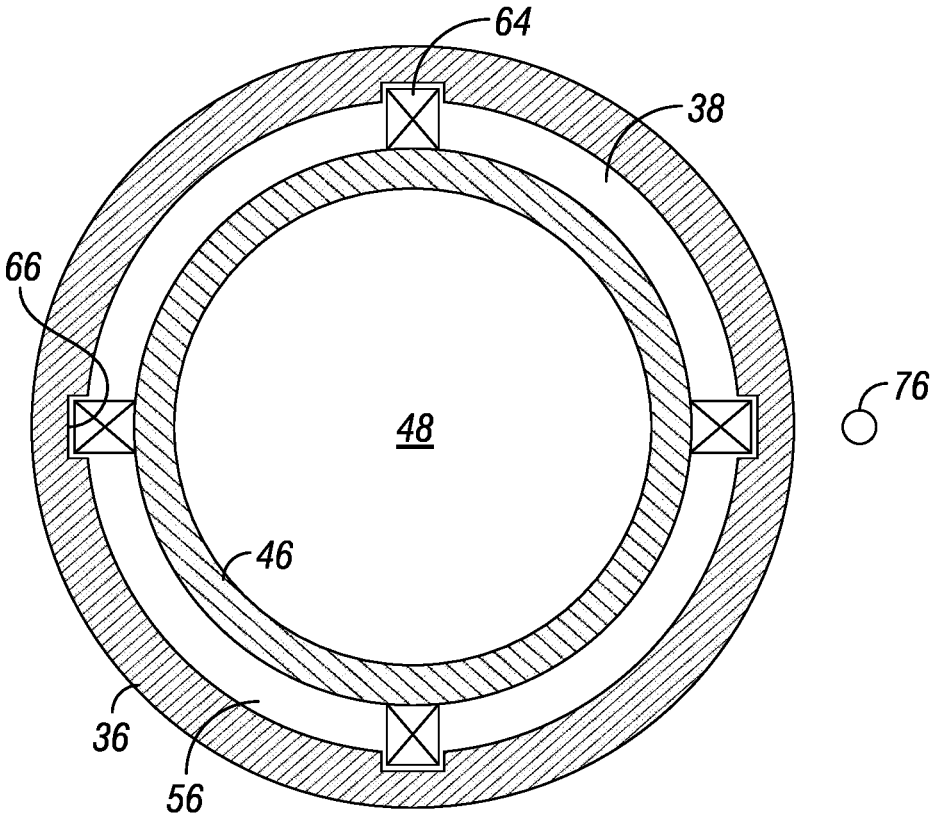
FIG. 4 is a schematic cross-sectional view of a telescoping connector joint, in accordance with an embodiment of this disclosure.

Second tubular member 46 can include lug 64. Lug 64 can protrude radially outward from second tubular member 46. Lug 64 can be located at or proximate to second mating end 50 of second tubular member 46. Lug 64 can have, for example, a generally cube or rectangular prism shape. Lug 64 can be secured to the outer diameter of second tubular member 46 or can be integrally formed with second tubular member 46. In the example embodiment of FIG. 4, there are four lugs 64 spaced evenly around the outer circumference of second tubular member 46. In alternate embodiments, there can be more or less than four lugs 64.

Lug 64 can engage recess 66 of first tubular member 36. Recess 66 has a cross section that corresponding to the cross section of lug 64 so that lug 64 can slide axially within recess 66. Recess 66 is an axially oriented groove within the inner diameter surface of first internal bore 38 of first tubular member 36.

Recess 66 has a recess bottom 68. Looking at FIG. 3, lug 64 can engage and be supported by recess bottom 68 when telescoping connector joint 30 is oriented to have a minimal length of second tubular member 46 within first tubular member 36. In such an orientation, the weight of telescoping connector joint 30, as well as the weight of production string 16 and any tools or equipment that make up or are part of production string 16 (FIG. 1) can be transferred from second tubular member 46 to first tubular member 36 by way of the interaction of lug 64 with recess bottom 68.

The weight of production string 16 and any tools or equipment that make up or are part of production string 16 that is supported through lug 64 would be maximized when lower isolation assembly 18 is disengaged and is not in sealing engagement with wellbore 12, and when downhole packer 24 is also disengaged and is not in sealing engagement with wellbore 12. As an example, the weight of production string 16 and any tools or equipment that make up or are part of production string 16 could be supported through lug 64 when installing production string 16 within wellbore 12 and before lower isolation assembly 18 and downhole packer are able to assist with supporting production string 16 within wellbore 12.

Telescoping connector joint 30 further includes wet connection 70. Wet connection 70 can be used to connect and disconnect segments of cable 22. Wet connection 70 can include female wet connect member 72 and male wet connect member 74. The example embodiments of FIGS. 2-3 show female wet connect member 72 secured to and located on first tubular member 36 and male wet connect member 74 secured to and located on second tubular member 46. In alternate embodiments, male wet connect member 72 can be secured to and located on first tubular member 36 and female wet connect member 74 can be secured to and located on second tubular member 46.

Uphole cable 76 can extend in a direction uphole from wet connection 70. Uphole cable 76 extends to tubing hanger 26. Uphole cable 76 is part of cable 22. Downhole cable 78 extends in a direction downhole from wet connection 70. Downhole cable 78 extends to downhole packer 24. Downhole cable 78 is also part of cable 22.

Looking at FIG. 2, telescoping connector joint 30 is in a connected configuration. In the connected configuration, female wet connect member 72 is in electrical, data, and signal communication engagement with male wet connect member 74 and a maximum length of second tubular member 46 is located within first internal bore 38. In the connected configuration, wet connection 70 uphole cable 76 and downhole cable 78 can provide electrical power, data, or other signal communication to downhole tools or equipment that are in need of such electrical power, data, or other signal communication. As an example, in the connected configuration, wet connection 70 uphole cable 76 and downhole cable 78 can be in power communication with ESP assembly 20 (FIG. 1) and cable 22 can provide power to ESP assembly 20.

Looking at FIG. 3, telescoping connector joint 30 is in an unconnected configuration. In the unconnected configuration female wet connect member 72 is free of electrical, data, and signal communication engagement with male wet connect member 74 and less than the maximum length of second tubular member 46 is located within first internal bore 38. In the unconnected configuration, wet connection 70 uphole cable 76 and downhole cable 78 cannot provide electrical power, data, or other signal communication to downhole tools or equipment. As an example, in the unconnected configuration, wet connection 70 uphole cable 76 and downhole cable 78 are not in power communication with ESP assembly 20 (FIG. 1) and cable 22 cannot provide power to ESP assembly 20.

Telescoping connector joint 30 can move between the connected configuration of FIG. 2 and the unconnected configuration of FIG. 3 by axial movement of first tubular member 36 relative to second tubular member 46. In order to move from the connected configuration of FIG. 2 to the unconnected configuration of FIG. 3, first tubular member 36 can undergo relative axial movement in a direction away from second tubular member 46. In order to move from the unconnected configuration of FIG. 3 to the connected configuration of FIG. 2, first tubular member 36 can undergo relative axial movement in a direction towards second tubular member 46.

In an example of operation, looking at FIG. 1, wellbore 12 can be drilled in a known manner. Production string 16 can be delivered into wellbore 12. When delivering production string 16 into wellbore 12, telescoping connector joint 30 can be in the unconnected configuration of FIG. 3 with the weight of the components of production string 16 downhole of lug 64 can be transferred from second tubular member 46 to first tubular member 36 by way of the interaction of lug 64 with recess bottom 68 of recess 66.

With lower isolation assembly 18 engaging an inner diameter surface of wellbore 12, lower isolation assembly 18 seals the space between production string 16 and wellbore 12. Downhole packer 24 can engage an inner diameter surface of wellbore 12 so that downhole packer 24 seals the space between downhole packer 24 and wellbore 12. Engagement of downhole packer 24 and lower isolation assembly 18 with wellbore 12 can support production string 16 within wellbore 12 so that components of production string 16 downhole of lugs 64 will remain static within wellbore 12 until such time as downhole packer 24 and lower isolation assembly 18 are disengaged from wellbore 12.

Tubing hanger 26 can then be lowered into operating position. Because components of production string 16 downhole of lugs 64 will remain static within wellbore 12 as tubing hanger 26 is being lowered into place, there will be relative axial movement between first tubular member 36 and second tubular member 46 and telescoping connector joint 30 will move from the unconnected configuration of FIG. 3 to the connected configuration of FIG. 2.

If during operations a problem with the power, data, or other signal communication provided by cable 22 to downhole tools or equipment may be detected. As an example, there may be a time when the supply of electrical power to ESP assembly 20 may be compromised. In order to troubleshoot the problem, a rigless workover barge can be dispatched. The barge can secure the well and remove the tree, by use of an overhead crane. The crane can then be used to lift tubing hanger 26 axially upward, stroking telescoping connector joint 30 to move from the connected configuration of FIG. 2 to the unconnected configuration of FIG. 3. The crane can lift telescoping connector joint 30 tubing hanger 26 axially upward the predetermined distance allowed by telescoping connector joint 30 without causing any axial movement of components of production string 16 downhole of second tubular member 46

With wet connection 70 disconnected, ESP assembly 20 is electrically decoupled from tubing hanger 26. A technician can then perform a continuity check across the hanger feed thrus, identify the shorted lead, and perform any necessary repairs. After the repair work is completed, tubing hanger 26 can be lowered back into position and there will be relative axial movement between first tubular member 36 and second tubular member 46 so that telescoping connector joint 30 will move from the unconnected configuration of FIG. 3 to the connected configuration of FIG. 2.

Therefore embodiments of this disclosure provide systems and methods for troubleshooting and repairing electrical cables and connections downhole of a tubing hanger without requiring the use of a workover rig. Embodiments of this disclosure further provide the ability to disconnect the power source from the ESP assembly while the troubleshooting and repair work is completed.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A telescoping connector joint for making an electrical connection, the telescoping connector joint including:

a first tubular member with a first internal bore;

a second tubular member with a second internal bore in fluid communication with the first internal bore, the second tubular member located within the first internal bore such than a joint annular space is defined between an outer diameter surface of the second tubular member and an inner diameter surface of the first internal bore;

an annular seal assembly sealing the joint annular space; and a female wet connect member located on and secured to an outer diameter surface of one of the first tubular member and the second tubular member and a male wet connect member located on and secured to the outer diameter surface of the other of the first tubular member and the second tubular member; where the female wet connect member and the male wet connect member are located radially external to the first tubular member and the second tubular member;

the telescoping connector joint has a connected configuration where the female wet connect member is in electrical engagement with the male wet connect member and a maximum length of the second tubular member is located within the first internal bore; and the telescoping connector joint has an unconnected configuration where the female wet connect member is free of electrical engagement with the male wet connect member and less than the maximum length of the second tubular member is located within the first internal bore.

2. The telescoping connector joint of claim 1, where the annular seal assembly includes a chevron seal located within the joint annular space.

3. The telescoping connector joint of claim 1, where the second tubular member includes a lug that protrudes radially outward, and where the lug engages an axially oriented recess located within the first internal bore.

4. The telescoping connector joint of claim 1, where the telescoping connector joint is operable to move from the connected configuration to the unconnected configuration by relative axial movement of the first tubular member in a direction away from the second tubular member.

5. A telescoping connector joint system for making an electrical connection, the telescoping connector joint system including:

a first tubular member with a first internal bore, the first tubular member having a first connector end secured to a first tubular joint, where the first internal bore has a first mating end that is opposite the first connector end of the first tubular member;

a second tubular member with a second mating end located within the first internal bore such that a joint annular space is defined between an outer diameter surface of the second tubular member and an inner diameter surface of the first internal bore, where the second tubular member has a second connector end that is opposite the second mating end and that is secured to a second tubular joint;

an annular seal assembly sealing the joint annular space;

a wet connection having a female wet connect member located on one of the first tubular member and the second tubular member and a male wet connect member located on the other of the first tubular member and the second tubular member;

a tubing hanger located uphole of the wet connection; and a downhole packer located downhole of the wet connection; where the telescoping connector joint system has a connected configuration where the female wet connect member is in electrical engagement with the male wet connect member and a maximum length of the second tubular member is located within the first internal bore; and the telescoping connector joint system has an unconnected configuration where the female wet connect member is free of electrical engagement with the male wet connect member and less than the maximum length of the second tubular member is located within the first internal bore;

where the telescoping connector joint system is operable to move from the connected configuration to the unconnected configuration by axial movement of the tubing hanger in a direction away from the downhole packer.

6. The telescoping connector joint system of claim 5, further including an uphole cable extending in a direction uphole from the wet connection to the tubing hanger, and a downhole cable extending in a direction downhole from the wet connection to the downhole packer.

7. The telescoping connector joint system of claim 6, further including an electrical submersible pump that is located downhole of the downhole packer, where when the telescoping connector joint system is in the connected configuration the uphole cable and the downhole cable are in power communication with the electrical submersible pump.

8. The telescoping connector joint system of claim 5, where the second tubular member includes a lug that protrudes radially outward, and where the lug engages an axially oriented recess located within the first internal bore, such that the lug is operable to transfer a weight of the telescoping connector joint system downhole of the lug to the first tubular member.

9. The telescoping connector joint system of claim 5, where the downhole packer is operable to engage an inner diameter surface of a wellbore and support a weight of the telescoping connector joint system downhole of second tubular member.

10. A method for making an electrical connection with a telescoping connector joint, the method including:

providing a first tubular member with a first internal bore;

locating a second tubular member with a second internal bore in fluid communication with the first internal bore within the first internal bore such than a joint annular space is defined between an outer diameter surface of the second tubular member and an inner diameter surface of the first internal bore;

sealing the joint annular space with an annular seal assembly;

locating a female wet connect member on and securing the female wet connect member to an outer diameter surface of one of the first tubular member and the second tubular member, and locating a male wet connect member on and securing the male wet connect member to an outer diameter surface of the other of the first tubular member and the second tubular member, so that the female wet connect member and the male wet connect member are located radially external to the first tubular member and the second tubular member; and moving the telescoping connector joint between an unconnected configuration and a connected configuration; where in the connected configuration, the female wet connect member is in electrical engagement with the male wet connect member and a maximum length of the second tubular member is located within the first internal bore; and in the unconnected configuration, the female wet connect member is free of electrical engagement with the male wet connect member and less than the maximum length of the second tubular member is located within the first internal bore.

11. The method of claim 10, where sealing the joint annular space with the annular seal assembly includes sealing the joint annular space with a chevron seal that is located within the joint annular space.

12. The method of claim 10, where the second tubular member includes a lug that protrudes radially outward, and the method further includes engaging an axially oriented recess located within the first internal bore with the lug to allow for relative axial movement between the first tubular member and the second tubular member.

13. The method of claim 10, further including moving the telescoping connector joint from the connected configuration to the unconnected configuration by relative axial movement of the first tubular member in a direction away from the second tubular member.

14. A method of making an electrical connection with a telescoping connector joint system, the method including:

providing a first tubular member with a first internal bore, where the first internal bore has a first mating end that is opposite a first connector end of the first tubular member;

locating a second tubular member with a second mating end within the first internal bore such than a joint annular space is defined between an outer diameter surface of the second tubular member and an inner diameter surface of the first internal bore, where the second tubular member has a second connector end opposite the second mating end;

sealing the joint annular space with an annular seal assembly;

locating a wet connection having a female wet connect member on one of the first tubular member and the second tubular member and locating a male wet connect member on the other of the first tubular member and the second tubular member;

securing the first connector end to a first tubular joint, and securing the second connector end to a second tubular joint;

installing a downhole packer downhole of the wet connection;

installing a tubing hanger uphole of the wet connection; where the telescoping connector joint system has a connected configuration where the female wet connect member is in electrical engagement with the male wet connect member and a maximum length of the second tubular member is located within the first internal bore; and the telescoping connector joint system has an unconnected configuration where the female wet connect member is free of electrical engagement with the male wet connect member and less than the maximum length of the second tubular member is located within the first internal bore; and further including moving the telescoping connector joint system from the connected configuration to the unconnected configuration by axial movement of the tubing hanger in a direction away from the downhole packer.

15. The method of claim 14, further including extending an uphole cable in a direction uphole from the wet connection to the tubing hanger, and extending a downhole cable in a direction downhole from the wet connection to the downhole packer.

16. The method of claim 15, further including locating an electrical submersible pump downhole of the downhole packer, and providing power to the electrical submersible pump with the uphole cable and the downhole cable when the telescoping connector joint system is in the connected configuration.

17. The method of claim 14, where the second tubular member includes a lug that protrudes radially outward, and where the lug engages an axially oriented recess located within the first internal bore, the method further including transferring a weight of the telescoping connector joint system downhole of the lug to the first tubular member by way of the lug.

18. The method of claim 14, further including engaging an inner diameter surface of a wellbore with the downhole packer and supporting a weight of the telescoping connector joint system downhole of the second tubular member with the downhole packer.

* * * * *